US010613565B2

(12) United States Patent
Kurnaz et al.

(10) Patent No.: US 10,613,565 B2
(45) Date of Patent: Apr. 7, 2020

(54) VOLTAGE REGULATOR WITH IMPEDANCE COMPENSATION

(71) Applicant: Apple Inc., Cupertino, CA (US)

(72) Inventors: Hande Kurnaz, Dettingen-Teck (DE); Ambreesh Bhattad, Swindon (GB); Gary Hague, Swindon (GB); Frank Kronmueller, Neudenau (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/376,037

(22) Filed: Apr. 5, 2019

(65) Prior Publication Data

US 2019/0235549 A1 Aug. 1, 2019

Related U.S. Application Data

(63) Continuation of application No. 15/943,806, filed on Apr. 3, 2018, now Pat. No. 10,324,482, which is a continuation of application No. 15/381,148, filed on Dec. 16, 2016, now Pat. No. 9,958,892.

(30) Foreign Application Priority Data

Dec. 17, 2015 (DE) ..... 10 2015 225 804

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/565; G05F 1/575
USPC ..... 323/273, 275, 280, 281
See application file for complete search history.

(56) References Cited

U.S. PATENT DOCUMENTS 9,958,892 B2 * 5/2018 Kurnaz ..... G05F 1/575
10,324,482 B2 * 6/2019 Kurnaz ..... G05F 1/575

* cited by examiner

*Primary Examiner* — Adolf D Berhane
(74) *Attorney, Agent, or Firm* — Kowert, Hood, Munyon, Rankin & Goetzel, P.C.

(57) ABSTRACT

A regulator configured to provide at an output node a load current at an output voltage is described. The regulator comprises a pass transistor for providing the load current at the output node. Furthermore, the regulator comprises feedback means for deriving a feedback voltage from the output voltage at the output node. In addition, the regulator comprises a differential amplifier configured to control the pass transistor in dependence of the feedback voltage and in dependence of a reference voltage. The regulator further comprises compensation means configured to determine a sensed current which is indicative of the load current at the output node. Furthermore, the compensation means are configured to adjust an operation point of the regulator in dependence of the sensed current and in dependence of a value of a track impedance of a conductive track which links the output node to a load.

28 Claims, 5 Drawing Sheets

VOLTAGE REGULATOR WITH IMPEDANCE COMPENSATION

This application is a Continuation of U.S. application Ser. No. 15/943,806 which was filed on Apr. 3, 2018, which is a continuation of Ser. No. 15/381,148, filed on Dec. 16, 2016 assigned to a common assignee, and which are herein incorporated by reference in their entirety.

TECHNICAL FIELD

The present document relates to a voltage regulator for supplying electrical energy to a load at a stable load voltage.

BACKGROUND

Voltage regulators are frequently used for providing a load current to different types of loads (e.g. to the processors of an electronic device). In this context it is typically desirable to supply the loads with stable load voltages, even if the load currents vary. In other words, it is desirable to maintain a stable voltage at a load, even subject to changing load currents.

SUMMARY

The present document addresses the technical problem of providing a cost-efficient voltage regulator, which is configured to provide stable load voltages at a load for varying load currents. According to an aspect, a regulator (notably a voltage regulator such as a linear dropout regulator) is described. The regulator is configured to provide at an output node of the regulator a load current at an output voltage. The output node of the regulator may be coupled to a load (e.g. to a processor) which is to be operated using the load current. The load may be coupled to the output node of the regulator via a conductive track (e.g. a conductive track of a printed circuit board, PCB). The regulator may be implemented as a regulator chip having an output pin as the output node. The regulator chip and the load (as part of a load chip) may be placed on the PCB.

The regulator comprises a pass transistor for providing the load current at the output node. The pass transistor may be configured to source the load current from a supply voltage of the regulator. The pass transistor may comprise a p-type or n-type metaloxide semiconductor transistor.

Furthermore, the regulator comprises feedback means for deriving a feedback voltage from the output voltage. In particular, the feedback means may be configured to provide a feedback voltage which is equal to a fraction of the output voltage. By way of example, the feedback means may comprise a voltage divider having a voltage divider ratio. The feedback voltage may be equal to the output voltage times the voltage divider ratio.

In addition, the regulator comprises a differential amplifier which is configured to control the pass transistor in dependence of the feedback voltage and in dependence of a reference voltage (notably in dependence of the difference of the feedback voltage and the reference voltage). In particular, the differential amplifier may be configured to provide a gate voltage which is applied to a gate of the pass transistor, wherein the gate voltage depends on the (difference of the) reference voltage and the feedback voltage. The differential amplifier may comprise a plurality of amplification stages, notably a differential amplification stage and a diver stage for generating the gate voltage for controlling the pass transistor.

The regulator further comprises compensation means which are configured to determine a sensed current that is indicative of the load current at the output node. In particular, the compensation means may comprise current sensing means which are configured to sense a current through the pass transistor for determining the sensed current. The current sensing means may be such that the sensed current is a scaled version of the current through the pass transistor. The current through the pass transistor is typically substantially equal to the load current.

Furthermore, the compensation means are configured to adjust an operation point of the regulator in dependence of the sensed current and in dependence of a value of a track impedance of the conductive track which links the output node to the load (notably in dependence of the product of the sensed current and the value of the track impedance). In particular, the compensation means may be configured to adjust an operation point of the regulator such that the output voltage at the output node is increased with increasing load current to compensate at least partially a track voltage at the track impedance. Alternatively or in addition, the compensation means may be configured to adjust an operation point of the regulator such that the load voltage at the load remains unchanged for different levels of the load current. Alternatively or in addition, the compensation means may be configured to adjust an operation point of the regulator such that the output voltage corresponds to the sum of a target voltage (given by the reference voltage) and of an estimated track voltage (which depends on the level of the sensed current and on the value of the track impedance, e.g. which is proportional to the product of the level of the sensed current and of the value of the track impedance).

As such, the regulator is configured to adjust the level of the output voltage which is set at the output node in order to compensate (at least partially) the track voltage at the track impedance of the conductive track between the output node and the load. By doing this, the load voltage at the load may be regulated to a fixed target voltage, without the need of an extra feedback pin for providing information regarding the actual load voltage to the regulator. As such, a cost-efficient regulator is provided, which provides a stable load voltage to a load of the regulator.

The compensation means may be configured to adjust the feedback means in dependence of the sensed current and in dependence of the value of the track impedance. In particular, the feedback means may comprise a voltage divider with an adjustable divider ratio and the compensation means may be configured to adjust the divider ratio in dependence of the sensed current and in dependence of the value of the track impedance. By doing this, the feedback voltage may be decreased with an increasing value of the sensed current, thereby increasing the level of the output voltage for compensating the (load current dependent) track voltage.

The feedback voltage may be provided to a first input of the differential amplifier. The compensation means may be configured to source a feedback current to or to sink a feedback current from the first input to adjust the feedback voltage, wherein the feedback current depends on the sensed current and on the value of the track impedance. In particular, a feedback current may be drawn from the first input to lower the level at the first input. The drawn feedback current may be increased with an increasing sensed current. As a result of this, the output voltage is increased for compensating the increasing track voltage.

The compensation means may be configured to adjust the reference voltage in dependence of the sensed current and in dependence of the value of the track impedance. In particular, the reference voltage may be increased with increasing sensed voltage to increase the output voltage for compensating the (load current dependent) track voltage.

The reference voltage may be applied to a second input of the differential amplifier. The compensation means may be configured to apply an offset voltage to the second input, wherein the offset voltage depends on the sensed current and on the value of the track impedance. The offset voltage may increase with increasing level of the sensed current, thereby increasing the output voltage at the output node for compensating the increasing track voltage. By doing this, the load voltage at the load may be maintained substantially unchanged (for varying load currents).

The compensation means may be configured to adjust an operation point of an internal node of the differential amplifier in dependence of the sensed current and in dependence of the value of the track impedance. As indicted above, the differential amplifier may comprise a plurality of amplification stages. The compensation means may be configured to source an adjustment current to or to sink an adjustment current from a node within at least one of the plurality of amplification stages, wherein the adjustment current depends on the sensed current and on the value of the track impedance. By doing this, the output voltage may be increased with increasing sensed current.

The compensation means may be configured to generate a virtual load node based on the output voltage, based on the sensed current and based on the value of the track impedance. In particular, the compensation means may comprise a compensation impedance which is dependent on the value of the track impedance. In particular, the compensation impedance may be a scaled version of the track impedance (e.g. N times the track impedance). Furthermore, the compensation means may comprise a compensation current source which provides a compensation current that is dependent on the sensed current. In particular, the compensation current may correspond to the current through the pass transistor divided by the factor N. The compensation impedance and the compensation current source may be arranged in series between the output node and ground, wherein the virtual load node corresponds to a midpoint between the compensation impedance and the compensation current source. As such, the voltage at the virtual load node corresponds to (or is proportional to) the load voltage at the load.

The feedback voltage may be derived based on the voltage at the virtual load node (e.g. using a voltage divider). By doing this, the load voltage at the load may be maintained substantially unchanged (for varying load currents), thereby improving the DC performance of the regulator.

Alternatively or in addition, the regulator may comprise a feedback capacitor which is coupled between the virtual load node and an internal node of the regulator. In particular, the feedback capacitor may couple the virtual load node (directly) to an output of the differential amplifier (e.g. to a midpoint between the differential amplifier and an intermediate amplification stage of the regulator). The use of a feedback capacitor, which is coupled to the virtual load node, improves the transient load regulation performance of the regulator, in case of substantial track impedances.

According to another aspect, a method for providing at an output node of a regulator a load current at an output voltage is described. The regulator comprises a pass transistor for providing the load current at the output node; feedback means for deriving a feedback voltage from the output voltage at the output node; and a differential amplifier for controlling the pass transistor in dependence of the feedback voltage and in dependence of a reference voltage.

The method comprises determining a sensed current which is indicative of the load current at the output node. Furthermore, the method comprises adjusting an operation point of the regulator in dependence of the sensed current and in dependence of a value of a track impedance of a conductive track which links the output node to a load.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
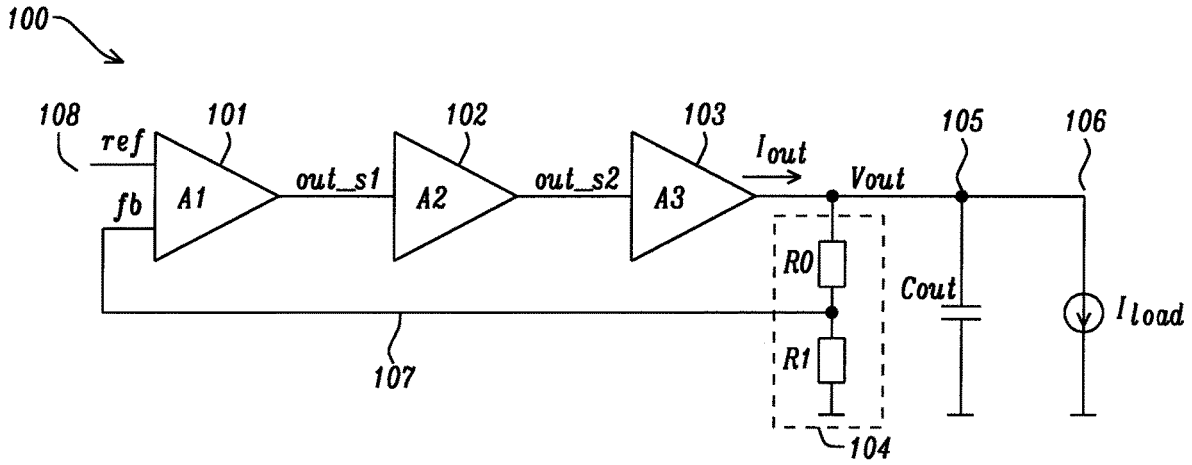
FIG. 1a Prior Art
FIG. 1*a* illustrates an example block diagram of an LDO regulator.

As outlined above, the present document is directed at providing a voltage regulator which is configured to provide a stable load voltage at a load for different levels of load currents. An example of a voltage regulator is an LDO regulator. A typical LDO regulator 100 is illustrated in FIG. 1*a*. The LDO regulator 100 comprises an output amplification stage 103, e.g. a field-effect transistor (FET), at the output and a differential amplification stage 101 (also referred to as error amplifier) at the input. A first input (fb) 107 of the differential amplification stage 101 receives a fraction of the output voltage $V_{out}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. to the power FET, changes by a feedback mechanism called main feedback loop to maintain a constant output voltage $V_{out}$.

The LDO regulator 100 of FIG. 1*a* further comprises an additional intermediate amplification stage 102 configured to amplify the output voltage of the differential amplification stage 101. An intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bybass capacitor) 105 parallel to the load 106. The output capacitor 105 is used to stabilize the output voltage $V_{out}$ subject to a change of the load 106, in particular subject to a change of the requested load current $I_{load}$. It should be noted that typically the output current $I_{out}$ at the output of the output amplification stage 103 corresponds to the load current $I_{load}$ through the load 106 of the regulator 100 (apart from typically minor currents through the voltage divider 104 and the output capacitance 105).

Figure 1B:
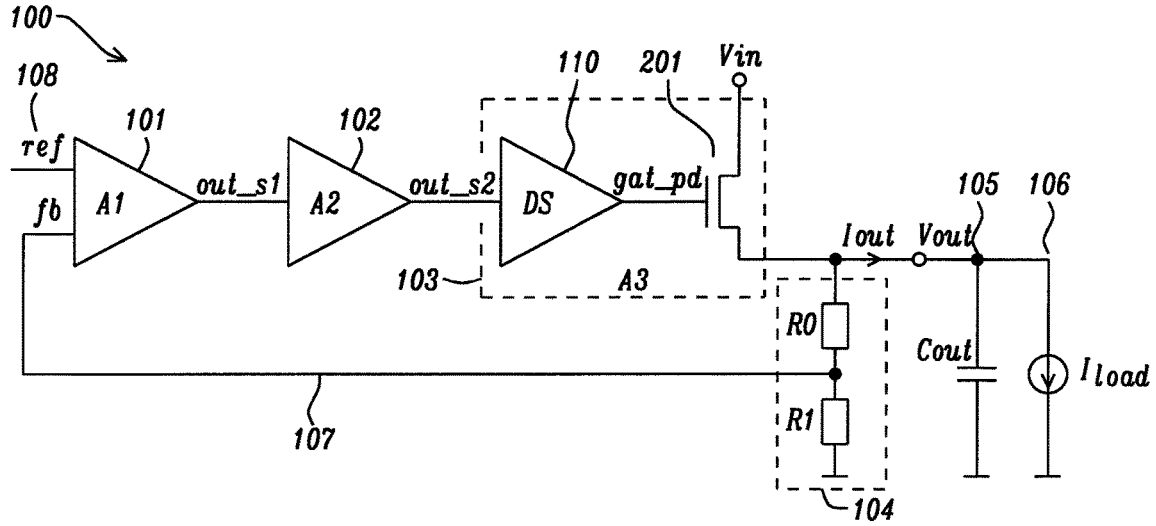
FIG. 1b Prior Art
FIG. 1*b* illustrates the example block diagram of an LDO regulator in more detail.

FIG. 1*b* illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 3V, an output voltage of 2V, and an output current or load current ranging from 1 mA to 100 or 200 mA. Other configurations are possible.

Figure 2A:
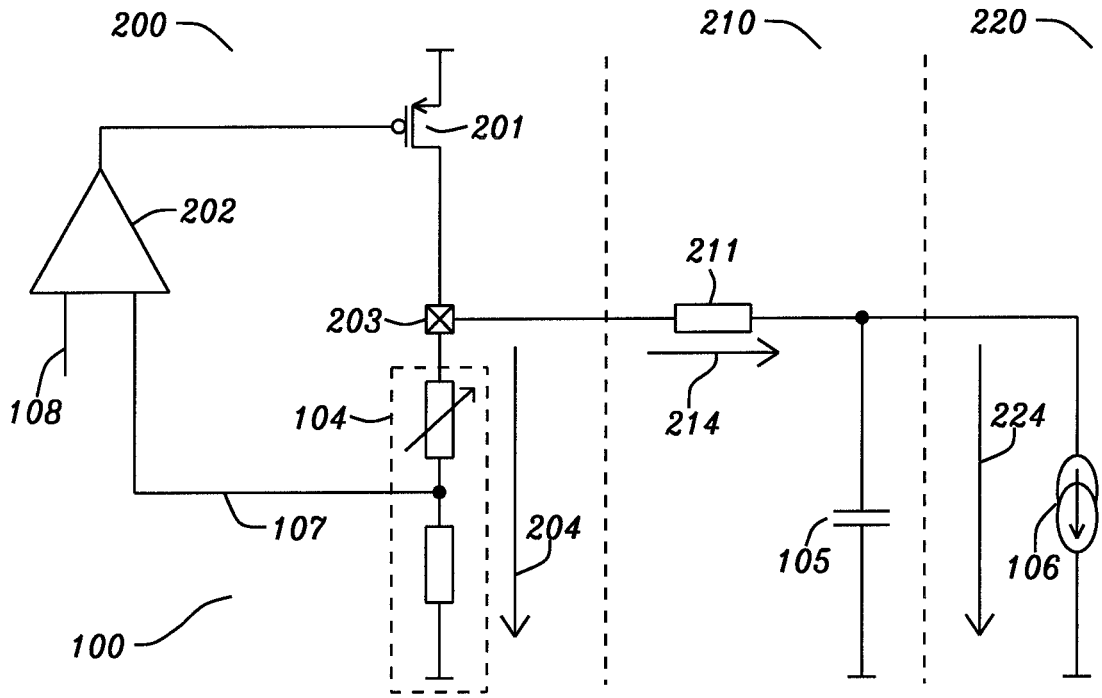
FIG. 2*a* shows a block diagram of an LDO regulator which is coupled to a load via a track impedance.

The regulator 100 is typically coupled to a load 106 via a conductive track of a printed circuit board (PCB). FIG. 2*a* shows an example regulator 100 implemented as a regulator chip 200 which is coupled to a load chip 220 (which comprises the load 106) via the conductive track of a PCB 210. The regulator chip 200 comprises an output pin 203 (i.e. an output node), and a conductive track of the PCB 210 may be coupled to the output pin 203 on one side and to the load chip 220 (e.g. to a processor) on the other side. The conductive track may exhibit an impedance (notably a resistance) 211, referred to herein as the track impedance or the track resistance. Typically the track impedance substantially corresponds to a track resistance.

The regulator 100 of FIG. 2*a* is configured to provide a stable output voltage 204 for different load currents. For this purpose, the regulator 100 comprises a feedback loop which feeds back (a fraction of) the output voltage 204 to the input of a differential amplifier 202 (comprising e.g. the differential amplification stage 101, the intermediate amplification stage 102 and the driver stage 110 of FIG. 1*b*). However, due to the voltage drop 214 at the track impedance 211 (which is referred to herein as the track voltage), the load voltage 224 at the load 106 differs from the output voltage 204. Furthermore, the load voltage 224 drops with increasing load current. This can be seen in FIG. 4*a* at the diagram referenced by the reference sign 402. It can be seen that the output voltage 204 is regulated to a fixed target voltage, wherein the output voltage is independent on the level of the load current 406. However, due to the track voltage 214 which is proportional to the load current 406 (with the track impedance 211 being the proportionality factor), the load voltage 224 decreases with increasing load current 406.

Figure 2B:
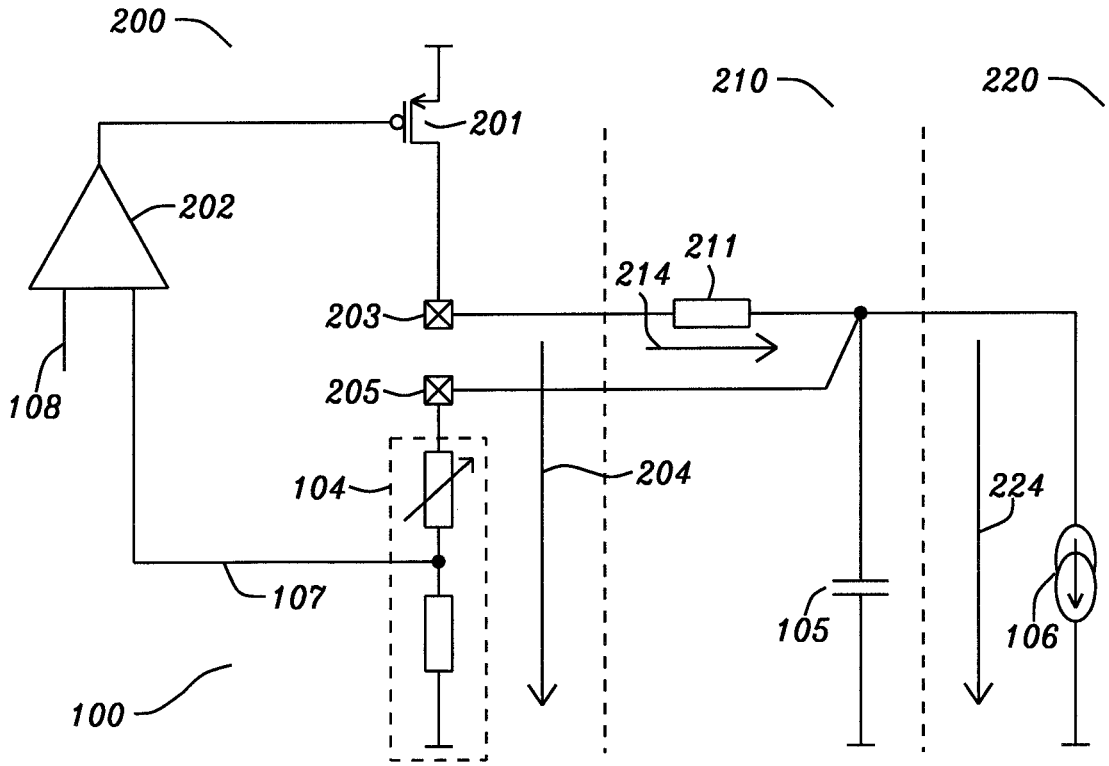
FIG. 2*b* shows a block diagram of an LDO regulator with an extra feedback pin for sensing the load voltage.

The decreasing load voltage 224 may impact the operation of the load 106. Hence, it is desirable to maintain the load voltage 224 at a fixed level, even if the load current 406 increases. FIG. 2*b* shows a modified regulator chip 200 which comprises a feedback pin 205 that may be directly coupled to the load chip 220 for sensing the load voltage 224. As a result of this, (a fraction of) the load voltage 224 may be fed back to the input of the differential amplifier 202, thereby regulating the output voltage 204 such that the load voltage 224 is maintained at a fixed target level (given by the reference voltage 108), even for changing load currents 406. As shown in the diagram 401 of FIG. 4*a*, the load voltage 224 is maintained at a fixed target voltage, while the output voltage 204 increases with increasing load current 406 to account for the track voltage 214.

Figure 3:
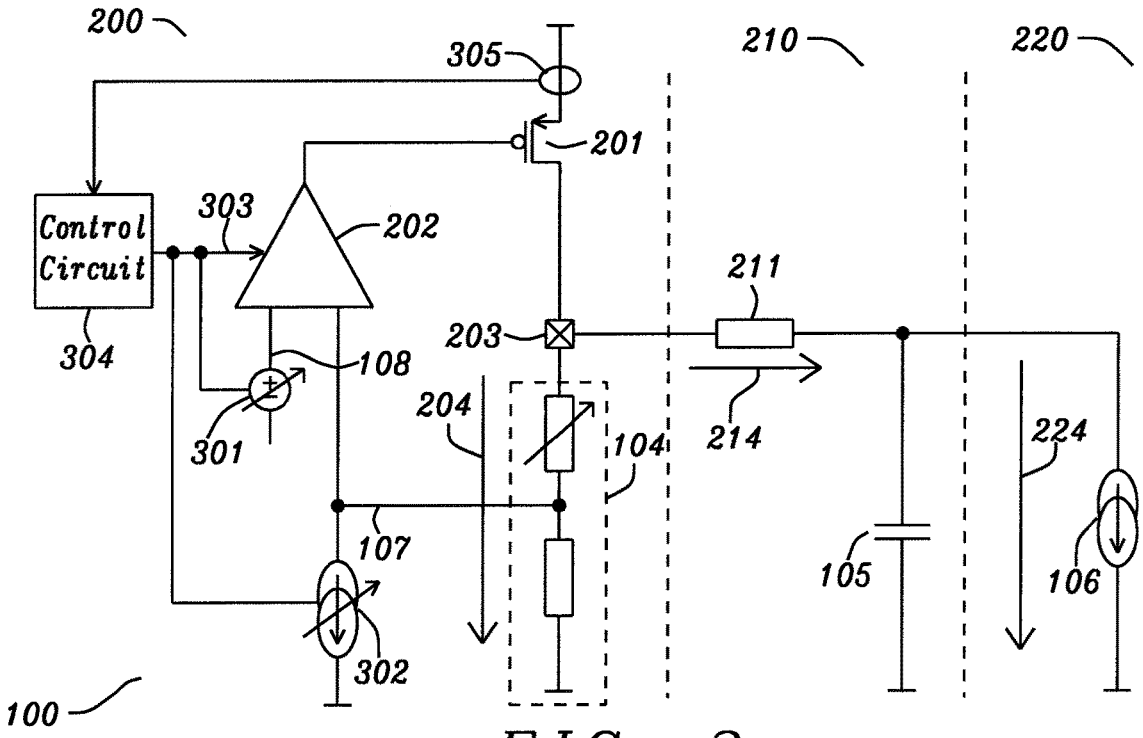
FIG. 3 shows a block diagram of an LDO regulator with impedance compensation means.

The regulator chip 200 of FIG. 2*b* is disadvantageous in that it requires an extra feedback pin 205, thereby increasing the cost of the regulator chip 200. As such, it is desirable to provide a regulator chip 200 which is configured to regulate the load voltage 224 to a fixed target level, without the need of an extra feedback pin 205. Such a regulator chip 200 is illustrated in FIG. 3. The regulator chip 200 of FIG. 3 comprises compensation means 301, 302, 303, 304, 305 for compensating the effects of the track impedance 211. A value of the track impedance 211 may be determined using the methods described e.g. in Abraham Mejía-Aguilar and Ramon Pallàs-Areny, "ELECTRICAL IMPEDANCE MEASUREMENT USING VOLTAGE/CURRENT PULSE EXCITATION", XIX IMEKO World Congress, Sep. 6-11, 2009, Lisbon, Portugal.

In particular, the compensation means 301, 302, 303, 304, 305 are configured to adapt the regulator 100 in dependence of the load current 406, such that the output voltage 204 at the output pin 203 of the regulator 100 corresponds to the sum of the fixed load voltage 224 (i.e. to the fixed target voltage given by the reference voltage 208) and of the (load current dependent) track voltage 214.

The compensation means 301, 302, 303, 304, 305 comprise current sensing means 305 which are configured to provided a sensed current which is indicative of the current through the pass transistor 201. The current sensing means 305 may comprise e.g. a scaled copy of the pass transistor 201 which is operated at the same drain-source voltage $V_{DS}$ as the pass transistor 201, such that the current through the scaled copy of the pass transistor 201 is proportional to the current through the pass transistor 201. In view of the fact that the current through the pass transistor 201 is substantially equal to the load current 406, the sensed current provides an indication of the load current 406.

The compensation means 301, 302, 303, 304, 305 may be configured to adapt the operation of the regulator 100 in dependence of the sensed current. In particular, the compensation means 301, 302, 303, 304, 305 may comprise a control circuit 304, which is configured to adjust the operation of the regulator 100 in dependence of the sensed current.

FIG. 3 illustrates three different means for adapting the regulator 100, wherein the means may be used separately or in combination. In particular, the control circuit 304 may be configured to adjust a level of the reference voltage 108 in dependence of the sensed current using voltage offset means 301. In particular, the reference voltage 108 may be increased linearly with an increasing sensed current, such that the output voltage 204 is increased in accordance to the increasing track voltage 214. The gradient of the linear increase typically depends on the (pre-determined) value of the track impedance 211.

Alternatively or in addition, the control circuit 304 may be configured to adjust the divider ratio of the voltage divider 104 and/or to offset the feedback voltage 107 (e.g. using the current source 302), in dependence of the sensed current.

Alternatively or in addition, the control unit 304 may be configured to adjust an internal node of the differential amplifier 202 (notably of the differential amplification stage 101), e.g. by inserting or removing a current proportional to the sensed current to an internal node of the differential amplifier 202.

Figure 4A:
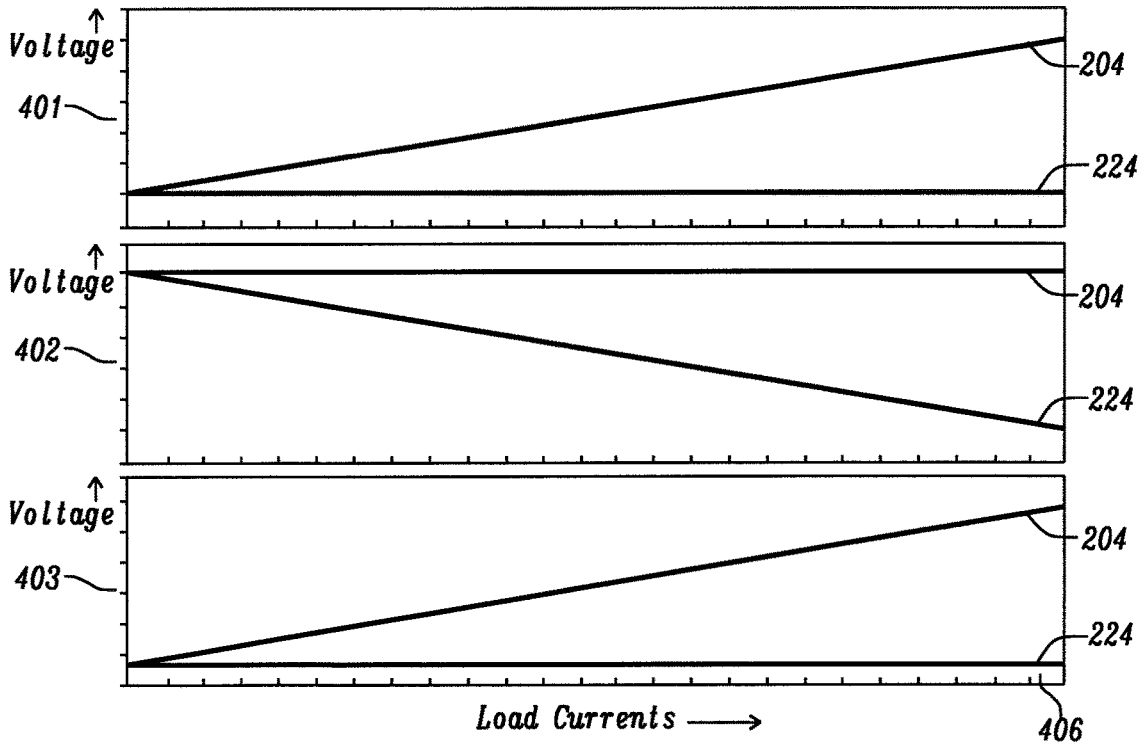
FIGS. 4*a* and 4*b* show example output voltages and load voltages.

FIG. 4*a* (reference sign 403) shows the output voltage 204 and the load voltage 224 for different load currents 406, which are obtained using the regulator chip 200 of FIG. 3. As can be seen, the load voltage 224 may be maintained at a fixed target level by adjusting the operation of the regulator 100.

As such, the regulator chip 200 of FIG. 3 is configured to sense the current through the track impedance 211 (which corresponds to the current through the pass transistor 201) and to use this information to increase the regulator output voltage 204 by a current dependent voltage, so that downstream of the tracking impedance or tracking resistor 211, the load voltage 224 at the load 106 is the same as the pre-determined target voltage.

The regulator output current (i.e. the pass device current) may be sensed, wherein the sensed current is e.g. Isense=Ipass/N, with N being a real number greater than one and with Ipass being the current through the pass transistor 201. If the value Rtrack of the track impedance 211 is known (e.g. by measurement of the resistance of the conductive track on the PCB 210), the sensed current Isense and the track impedance information may be used to modify the main regulation loop of the regulator 100 to regulate the output voltage 224 to Vtarget+Rtrack*Iout, wherein Vtarget is the target voltage for the load voltage 224 (given by the reference voltage 108), wherein Rtrack is the value of the track impedance/resistance 211 and wherein Iout is the load current 406 (indicated by the sensed current).

Modifying the main regulator loop may be implemented in various ways. As illustrated in FIG. 3, the reference voltage 108 may be adjusted (e.g. regulated) by the control unit 304 to increase proportionally to the sensed current and to the track impedance 211 (notably to the product of the sensed current and the track impedance 211). Alternatively or in addition, the resistor divider 104 may be adjusted. In particular, a current proportional to the sensed current and to the track impedance 211 (notably to the product thereof) may be stolen from the resistor divider 104 to trick the regulator 100 into a different divider ratio, thereby regulating the output voltage 204 to an increased voltage level. Alternatively or in addition, the divider ratio may be adjusted accordingly. Alternatively or in addition, an internal node of the regulator 100 may be adjusted. In particular, a current proportional to the sensed current and to the track impedance 211 (notably to the product thereof) may be stolen from or sourced into one of the stages 101, 102, 103 of the regulator 100 to trick the regulator 100 into a different operating point, thereby regulating the output voltage 204 to an increased voltage level.

Figure 5:
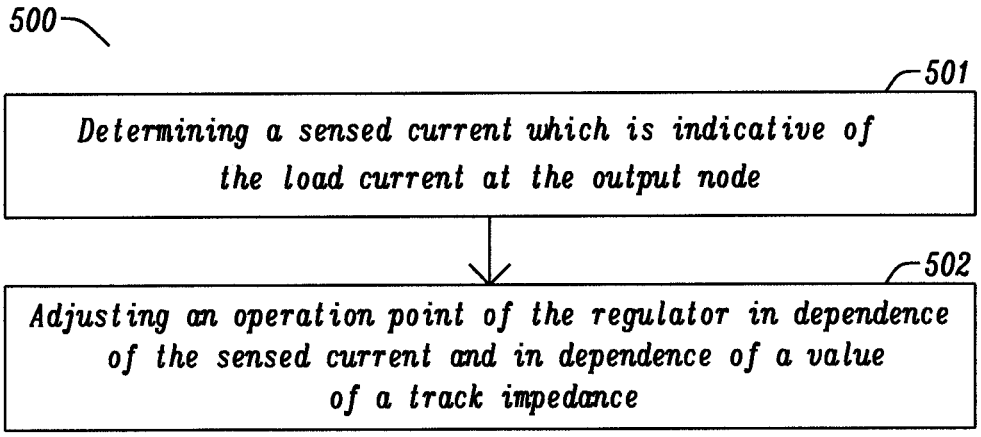
FIG. 5 shows a flow chart of an example method for regulating the load voltage at a load.

FIG. 5 shows a flow chart of an example method 500 for providing at an output node 203 of a regulator 100, 200 a load current 406 at an output voltage 204. The load current 406 may be provided to a load 106 via a conductive track (e.g. a conductive track of a PCB 210). The regulator 100 may be implemented on a regulator chip 200.

The regulator 100, 200 comprises a pass transistor 201 for providing the load current 406 at the output node 203. Furthermore, the regulator 100, 200 comprises feedback means 104 for deriving a feedback voltage 107 from the output voltage 204 at the output node 203 (e.g. using a voltage divider 104). In addition, the regulator 100, 200 comprises a differential amplifier 202 for controlling the pass transistor 201 in dependence of the feedback voltage 107 and in dependence of a reference voltage 108 (notably in dependence of a difference between the feedback voltage 107 and the reference voltage 108).

The method 500 comprises determining 501 a sensed current which is indicative of the load current 406 at the output node 203. Furthermore, the method 500 comprises adjusting 502 an operation point of the regulator 100 in dependence of the sensed current and in dependence of a value of a track impedance 211 of the conductive track which links the output node 203 to the load 106 (notably in dependence of the product of the sensed current and the value of the track impedance 211).

As such, a regulator chip 200 (and a corresponding method 500) is described which is configured to perform a point-of load regulation without the need of an extra feedback pin 205. The regulator chip 200 makes use of an estimated voltage drop 214 over the track impedance 211 to regulate the voltage 224 at the point of load.

Figure 6:
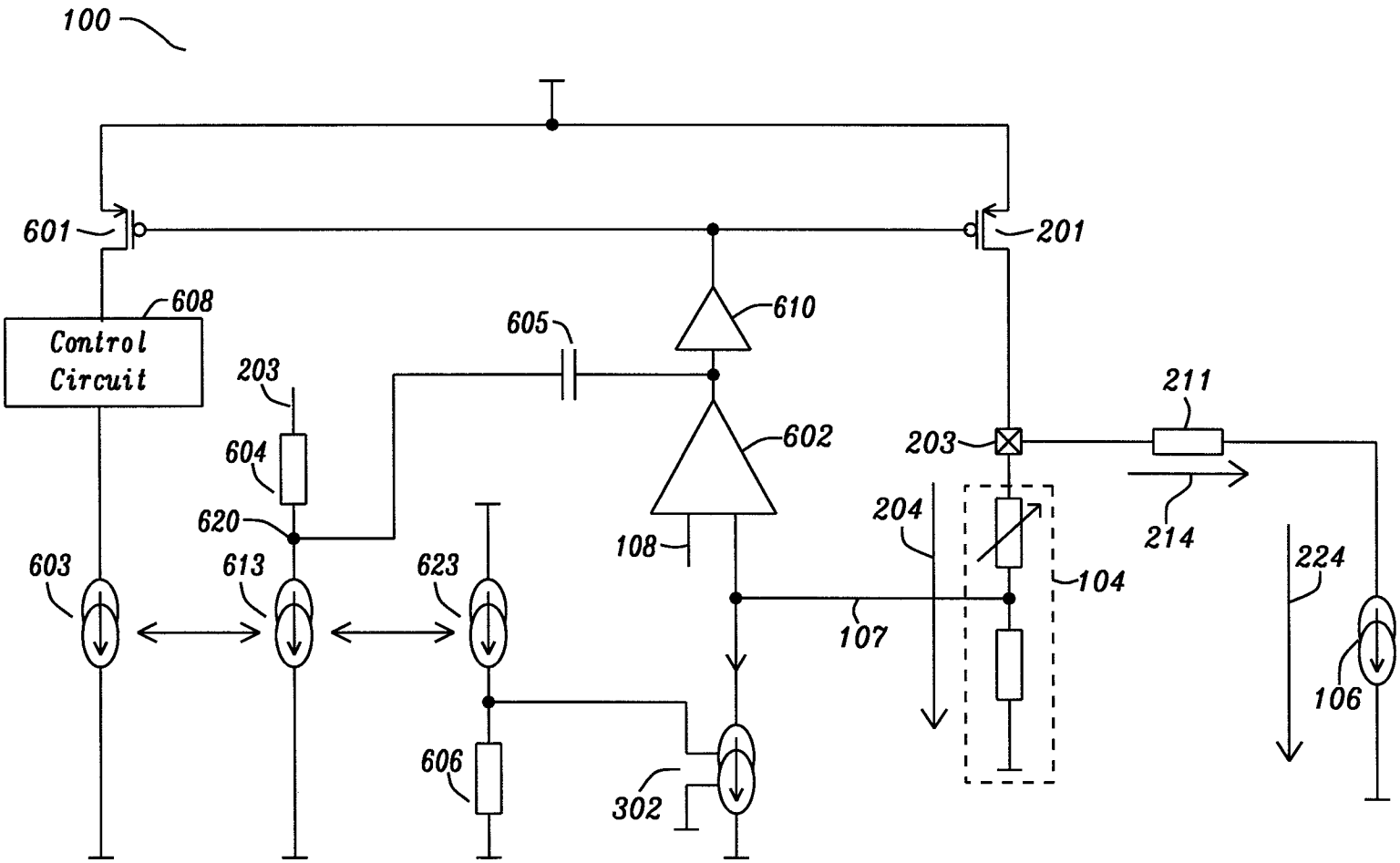
FIG. 6 shows a block diagram of an LDO regulator comprising a feedback capacitor.

FIG. 6 shows a regulator 100 which comprises a feedback capacitor 605 (also referred to as a Miller capacitor) for coupling the output node 203 to an internal node of the regulator 100. In the illustrated example the feedback capacitor 605 couples the output node 203 to the output of the differential amplification stage 101, 602. The feedback capacitor 605 may be used to improve the transient response of the regulator 100. In particular, the feedback capacitor 605 may be used to increase the reaction speed of the regulator 100 subject to a load transient.

In a similar manner to the steady-state/DC regulation, the transient load regulation typically suffers from the fact that the output voltage 204 at the output node 203 differs from the load voltage 224 across the load 106. The transient increase of the load current 410 (see FIG. 4*b*) through the load 106 leads to a substantial increase of the track voltage 214 across the track impedance 211. As a result of this, the load voltage 224, 411 decreases substantially, while the output voltage 204, 412 at the output node 203 remains substantially constant. The drop of the load voltage 224, 411 may lead to instabilities of the load 106 (e.g. a processor). Furthermore, the reduced impact of the transient of the load current 410 on the output voltage 204 at the output node 203 lead to a reduced impact of the feedback loop via the feedback capacitor 605.

The regulator 100 of FIG. 6 comprises compensation means 604, 613 which are configured to generate a virtual load node 620 from the output voltage 204 at the output node 203. In particular, the compensation means 604, 613 comprise a compensation impedance 604 (e.g. a compensation resistor) which is a scaled copy of the track impedance 211 (e.g. N times the track impedance). Furthermore, the compensation means 604, 613 comprise a compensation current source 613 which is configured to provide a scaled version of the sensed current (e.g. to provide the sensed current which corresponds to the load current divided by the factor N). The compensation impedance 604 and the compensation current source 613 are arranged in series between the output node 203 and ground. As a result of this, the (scaled) sensed current flows through the compensation impedance 604, such that the voltage drop at the virtual load node 620 corresponds to the load voltage 224 (or a scaled version thereof). The feedback capacitor 605 is arranged between the virtual load node 620 and an internal node of the regulator 100.

Figure 4B:
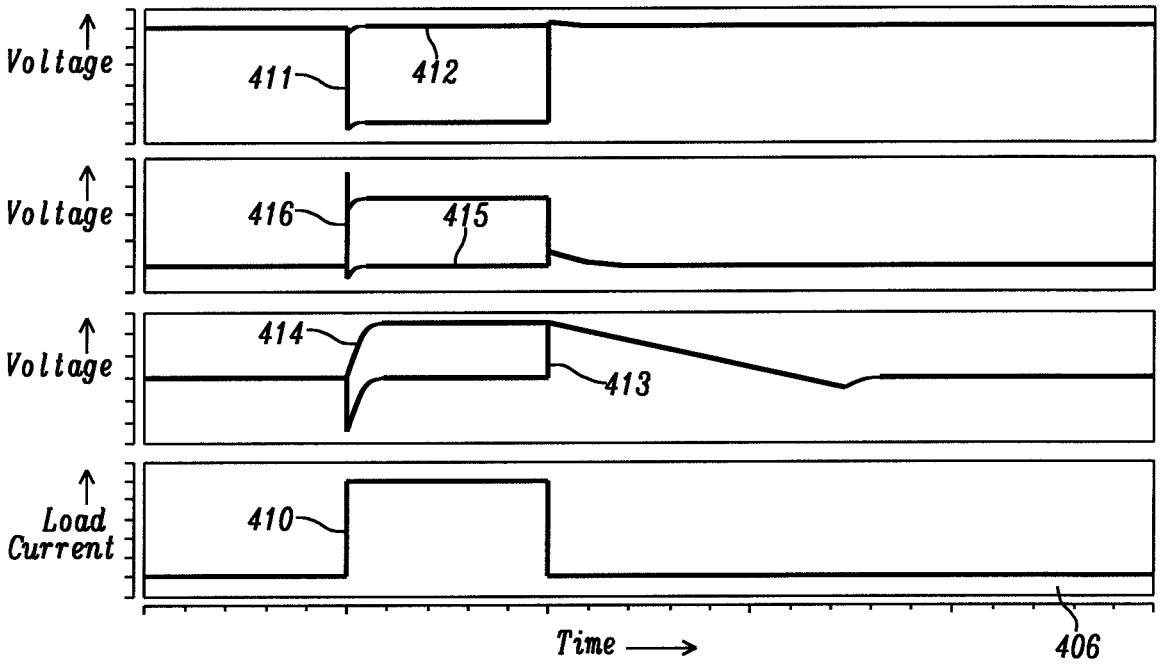

As such, a replica of the load voltage 224 may be fed back using the feedback capacitor 605, thereby increasing the transient load performance of the regulator 100. This is illustrated in FIG. 4*b*. In particular, it can be seen that by feeding back the voltage at the virtual load node 620 using a feedback capacitor 605, the load voltage 224, 413 remains substantially constant subject to a transient of the load current 410. On the other hand, the output voltage 204, 414 is increased (due to the additional track voltage 214).

FIG. 6 illustrates example current sensing means 305 which comprise a replica transistor 601 being a scaled version of the pass transistor 201 (e.g. being smaller than the pass transistor 201 by a factor N). Furthermore, the current sensing means 305 comprise a control circuit 608 which is configured to maintain the drain-source voltage ($V_{DS}$) of the replica transistor 601 equal to the $V_{DS}$ of the pass transistor 201. As a result of this, it can be ensured that the current through the replica transistor 601 is a scaled version (e.g. by a factor N) of the current through the pass transistor 201 (e.g. N times smaller than the current through the pass transistor 201).

The sensed current (through the current source 603) may be copied to the compensation current source 613 (for creating the virtual load node 620). Alternatively or in addition, the sensed current may be copied to the current source 623 for steady-state/DC compensation of the regulator 100 (as outlined in the context of FIG. 3). In the illustrated example, the compensation means 623, 606, 302 for steady-state compensation comprise an impedance 606 which is dependent on the track impedance 211 (e.g. which is N times the track impedance 211). The compensation means 623, 606, 302 shown in FIG. 6 may be used to offset the feedback voltage 108 (by a scaled version of the track voltage 214), such that the feedback voltage corresponds to a scaled version of the load voltage 224.

As illustrated in FIG. 6, the steady-state/DC compensation (as outlined in the context of FIG. 3) may be combined with the transient compensation (as outlined in the context of FIG. 6). As a result of this, the performance of the regulator 100 may be increased further. FIG. 4*b* shows the load voltage 224, 415 provided by the regulator 100 of FIG. 6 subject to a transient of the load current 410. It can be seen that the load voltage 224, 415 is maintained substantially constant. On the other hand, the output voltage 204, 416 increases to compensate for the track voltage 214.

As such, the transient behaviour of the regulator 100 may be improved in the presence of a track impedance 211. In case of an abrupt load current request, the output capacitor 105 reacts first to deliver the required load current 410. After the response time of the regulator 100, the pass transistor 201 starts delivering the load current 410. The sensed current of the current sensing device 305, 601, 608 may be used to manipulate or adjust one or more internal nodes of the regulator 100. In particular, a slope based current which is generated using the information on the sensed current and on the track impedance may be fed back into the regulator 100 through the feedback capacitor 605.

As such, compensation means may be provided to improve the DC (steady-state) and transient load regulation of a regulator 100 in case of relatively high track impedances 211. The figures shown in the present document show PMOS pass transistors 201. It should be noted that the aspects which are outlined in the present document are equally applicable to NMOS regulators with NMOS pass transistors. The compensation means outlined in the present document do not require an extra sensing pin for determining the load voltage 224. Instead, the compensation means make use of internal current sensing means 305 for sensing the current through the pass transistor 201 (i.e. for sensing the load current) and of information regarding the track impedance 211. As a result of this, a virtual load node 620 may be generated, which reflects the load voltage 224. By doing this, an efficient regulator 100 with improved DC and transient performance may be provided.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A regulator configured to provide at an output node a load current at an output voltage, wherein the regulator comprises:

a pass transistor for providing the load current at the output node;

feedback means for deriving a feedback voltage from the output voltage at the output node;

a differential amplifier configured to control the pass transistor in dependence of the feedback voltage and in dependence of a reference voltage; and compensation means configured to:

determine a sensed current which is indicative of the load current at the output node;

adjust an operation point of the regulator in dependence of the sensed current and in dependence of a value of a track impedance of a conductive track which links the output node to a load, such that the output voltage at the output node is increased with increasing load current to compensate at least partially a track voltage at the track impedance; and adjust an operation point of an internal node of the differential amplifier in dependence of the sensed current and in dependence of the value of the track impedance.

2. The regulator of claim 1, wherein the compensation means are configured to adjust the operation point of the regulator such that a load voltage at the load remains unchanged for different levels of the load current.

3. The regulator of claim 1, wherein the compensation means are configured to adjust an operation point of the regulator such that the output voltage corresponds to a sum of a target voltage given by the reference voltage and of an estimated track voltage which depends on a level of the sensed current and on the value ofthe track impedance.

4. The regulator of claim 1, wherein the compensation means are configured to adjust the feedback means in dependence of the sensed current and in dependence of the value of the track impedance.

5. The regulator of claim 4, wherein the feedback means comprise a voltage divider with a divider ratio, and wherein the compensation means are further configured to adjust the divider ratio in dependence of the sensed current and in dependence of the value of the track impedance.

6. The regulator of claim 1, wherein the feedback voltage is provided to a first input of the differential amplifier; wherein the compensation means are further configured to source a feedback current to or to sink a feedback current from the first input to adjust the feedback voltage; and wherein the feedback current depends on the sensed current and on the value of the track impedance.

7. The regulator of claim 1, wherein the compensation means are further configured to adjust the reference voltage in dependence of the sensed current and in dependence of the value of the track impedance.

8. The regulator of claim 7, wherein the reference voltage is applied to a second input of the differential amplifier, wherein the compensation means are further configured to apply an offset voltage to the second input and the offset voltage depends on the sensed current and on the value of the track impedance.

9. The regulator of claim 8, wherein the differential amplifier includes a plurality of amplification stages, wherein the compensation means are further configured to source an adjustment current to or to sink an adjustment current from a node within at least one of the plurality of amplification stages, and wherein the adjustment current depends on the sensed current and on the value of the track impedance.

10. The regulator of claim 1, wherein the compensation means comprise current sensing means configured to sense a current through the pass transistor for determining the sensed current.

11. The regulator of claim 10, wherein the current sensing means are such that the sensed current is a scaled version of the current through the pass transistor.

12. The regulator of claim 1, wherein the compensation means are further configured to generate a virtual load node based on the output voltage, based on the sensed current and based on the value of the track impedance, and wherein the regulator comprises a feedback capacitor which is arranged between the virtual load node and an internal node of the regulator.

13. The regulator of claim 12, wherein the compensation means comprise a compensation impedance which is dependent on the value of the track impedance, wherein the compensation means further comprise a compensation current source which provides a compensation current that is dependent on the sensed current, wherein the compensation impedance and the compensation current source are arranged in series between the output node and ground and wherein the virtual load node corresponds to a midpoint between the compensation impedance and the compensation current source.

14. The regulator of claim 12, wherein the feedback capacitor couples the virtual load node to an output of the differential amplifier.

15. A method providing at an output node of a regulator a load current at an output voltage, wherein the regulator comprises a pass transistor for providing the load current at the output node; feedback means for deriving a feedback voltage from the output voltage at the output node; and a differential amplifier for controlling the pass transistor in dependence of the feedback voltage and in dependence of a reference voltage; wherein the method comprises:

determining a sensed current which is indicative of the load current at the output node;

adjusting an operation point of the regulator in dependence of the sensed current and in dependence of a value of a track impedance of a conductive track which links the output node to a load such that the output voltage at the output node is increased with increasing load current to compensate at least partially a track voltage at the track impedance; and adjusting an operation point of an internal node of the differential amplifier in dependence of the sensed current and in dependence of the value of the track impedance.

16. The method of claim 15, wherein the method further comprises adjusting an operation point of the regulator such that a load voltage at the load remains unchanged for different levels of the load current.

17. The method of claim 15, wherein the method further comprises adjusting an operation point of the regulator such that the output voltage corresponds to a sum of a target voltage given by the reference voltage and of an estimated track voltage which depends on a level of the sensed current and on the value of the track impedance.

18. The method of claim 15, wherein the method further comprises adjusting the feedback means in dependence of the sensed current and in dependence of the value of the track impedance.

19. The method of claim 18, wherein the feedback means comprise a voltage divider with a divider ratio, and wherein the method further comprises adjusting the divider ratio in dependence of the sensed current and in dependence of the value of the track impedance.

20. The method of claim 15, wherein the feedback voltage is provided to a first input of the differential amplifier, wherein the method further comprises sourcing a feedback current to or sinking a feedback current from the first input to adjust the feedback voltage, and wherein the feedback current depends on the sensed current and on the value of the track impedance.

21. The method of claim 15, wherein the method further comprises adjusting the reference voltage in dependence of the sensed current and in dependence of the value of the track impedance.

22. The method of claim 21, wherein the reference voltage is applied to a second input of the differential amplifier, wherein the method further comprises applying an offset voltage to the second input and wherein the offset voltage depends on the sensed current and on the value of the track impedance.

23. The method of claim 22, wherein the differential amplifier comprises a plurality of amplification stages, wherein the method further comprises sourcing an adjustment current to or sinking an adjustment current from a node within at least one of the plurality of amplification stages, and wherein the adjustment current depends on the sensed current and on the value of the track impedance.

24. The method of claim 15, wherein the method further comprises sensing a current through the pass transistor for determining the sensed current.

25. The method of claim 24, wherein the sensed current is a scaled version of the current through the pass transistor.

26. The method of claim 15, wherein the method further comprises generating a virtual load node based on the output voltage, based on the sensed current and based on the value of the track impedance, and wherein the regulator comprises a feedback capacitor which is arranged between the virtual load node and an internal node of the regulator.

27. The method of claim 26, wherein a regulator comprises compensation means for:

the determining a sensed current which is indicative of the load current at the output node;

the adjusting an operation point of the regulator in dependence of the sensed current and in dependence of a value of a track impedance of a conductive track which links the output node to a load;

the adjusting an operation point of an internal node of the differential amplifier in dependence of the sensed current and in dependence of the value of the track impedance; and the generating a virtual load node based on the output voltage, based on the sensed current and based on the value of the track impedance;

wherein the compensation means comprise a compensation impedance which is dependent on the value of the track impedance;

wherein the compensation means comprise a compensation current source which provides a compensation current that is dependent on the sensed current;

wherein the compensation impedance and the compensation current source are arranged in series between the output node and ground; and wherein the virtual load node corresponds to a midpoint between the compensation impedance and the compensation current source.

28. The method of claim 26, wherein the feedback capacitor couples the virtual load node to an output of the differential amplifier.

* * * * *